United States Patent [19]

Kawasaki et al.

[11] 4,064,022

[45] Dec. 20, 1977

[54] METHOD OF RECOVERING METALS FROM SLUDGES

[75] Inventors: Motoo Kawasaki, Hirakata; Shozo Mizumoto, Takarazuka; Hidemi Nawafune, Takatsuki, all of Japan

[73] Assignees: Motoo Kawasaki, Hirakata; Ebara-Udylite Co., Ltd., Tokyo, both of Japan

[21] Appl. No.: 636,706

[22] Filed: Dec. 1, 1975

[30] Foreign Application Priority Data

Dec. 10, 1974 Japan ..... 49-142263

[51] Int. Cl.[2] ..... C25C 1/12; C25C 1/08; C25C 1/10; C25C 1/16

[52] U.S. Cl. ..... 204/105 R; 204/106; 204/107; 204/108; 204/112; 204/113

[58] Field of Search ..... 204/105 R, 107, 106, 204/108, 112–113

[56] References Cited

U.S. PATENT DOCUMENTS

| | | | |
|---|---|---|---|
| 1,251,511 | 1/1918 | Guess | 204/112 |
| 1,276,130 | 8/1918 | Smith | 204/108 |
| 2,653,905 | 9/1953 | Aannerud | 204/112 |
| 3,072,545 | 1/1963 | Juda et al. | 204/263 |
| 3,787,293 | 1/1974 | Kametani | 204/112 |
| 3,953,306 | 4/1976 | Lancy | 204/112 |

*Primary Examiner*—R. L. Andrews
*Attorney, Agent, or Firm*—Brisebois & Kruger

[57] ABSTRACT

A sludge containing a sparingly soluble metal compound such as nickel carbonate or the like is supplied to an anode compartment or an intermediate compartment of an electrolytic cell provided with an anode compartment and a cathode compartment or with an anode compartment, an intermediate compartment and a cathode compartment each sectioned by a filter membrane or an ion-exchange membrane, and thereafter an electrolytic treatment is conducted by using an insoluble electrode as anode and a usual electrode as cathode to precipitate a metal such as nickel on the cathode. Effective recovery of a metal is attained directly from a sludge by way of electrolysis.

6 Claims, 4 Drawing Figures

METHOD OF RECOVERING METALS FROM SLUDGES

BACKGROUND OF THE INVENTION

The present invention relates to a method of recovering metals from sludges or the like deposits containing sparingly soluble metal compounds such as metal hydroxides formed in the course of treatments of industrial effluents.

Hitherto, industrial effluents discharged in the step of the surface treatments of metals or the electrolytic refinement of metals were usually neutralized with an alkali to precipitate various kinds of metal ions constituting a source of pollution as sparingly soluble metal compounds such as metal hydroxides and carbonates, and then the precipitate was separated as sludge by floatation or deposition. As a complete treatment of the resulting sludge for preventing any secondary pollution is difficult, the prior art method of disposing the sludges in such circumstance comprises concentrating the sludges by dehydration, fixing the concentrates with concrete and then using it for reclamation.

With a view to attaining effective re-utilization of limited expensive metal resources and prevention of environmental pollution, the present inventors have made researches for effectively recovering metals directly from sludges containing sparingly soluble metal compounds in the form of metal hydroxides, oxides, salts, etc. released in the treatment of industrial effluents. The present invention is based on such researches.

BRIEF SUMMARY OF THE INVENTION

In accordance with the present invention, there is provided a method of recovering metals from sludges, characterized by supplying a sludge or the like deposit containing sparingly soluble metal compounds to an anode compartment or an intermediate compartment of an electrolytic cell provided with an anode compartment and a cathode compartment or with an anode compartment, an intermediate compartment and a cathode compartment each sectioned by a filter membrane or an ion-exchange membrane, conducting an electrolytic treatment by using an insoluble electrode as anode and a usual electrode as cathode to precipitate metals on the cathode and thereafter recovering the precipitated metals.

It is an object of the present invention to provide a novel method of recovering metals directly from sludges or the like deposits by way of an electrolytic treatment.

It is another object of the present invention to provide a method of efficiently electrolyzing sludges or the like deposits to recover metals contained therein.

It is still another object of the present invention to provide a method of economically recovering metals with desirable properties from sludges or the like deposits by way of an electrolytic treatment.

BRIEF DESCRIPTION OF THE DRAWINGS

Other objects, features and advantages of the present invention will be apparent from the following description taken in connection with the accompanying drawings, wherein.

DETAILED DESCRIPTION OF THE INVENTION

Figure 1:
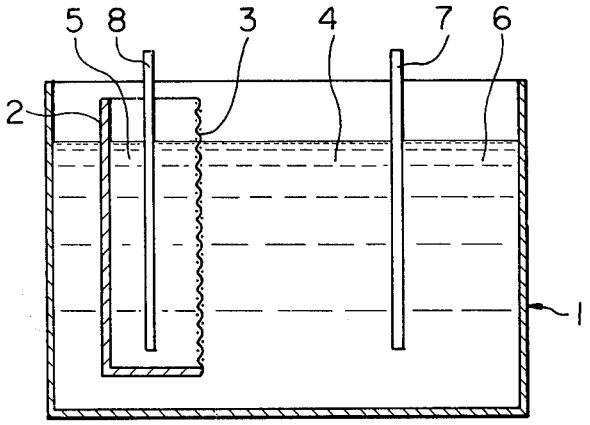
FIG. 1 is a cross-sectional view of an electrolytic cell preferable in practice of the present invention.

In the present invention, an electrolytic cell is sectioned by a filtering membrane or an ion-exchange membrane into an anode compartment and a cathode compartment or into an anode compartment, an intermediate compartment and a cathode compartment. An insoluble electrode is used as anode and an electrolytic treatment is carried out by supplying a sludge or the like deposit containing sparingly soluble metal compounds to the anode compartment or the intermediate compartment.

Examples of the sludges supplied according to the method of this invention to the anode compartment or the intermediate compartment include those containing metal hydroxides such as nickel hydroxide, cupric hydroxide and chromium hydroxide; metal oxides such as nickel oxides, cupric oxide and chromium oxide; metal carbonates such as nickel carbonate; metal basic carbonates such as nickel basic carbonate and cupric basic carbonate; and other sparingly soluble metal compounds. The term "sludge" used herein includes a dry powdery substance such as a burnt sludge ash in addition to a sludge in a usual meaning. In the anode compartment or the intermediate compartment, such sludge is dissolved in the electrolytic solution by the action of hydrogen ion formed by the reaction shown below.

$$2H_2O \rightarrow O_2 + 4H^+ + 4e^-$$

This dissolution reaction can be shown, for example, by the following formulas:

$$Ni(OH)_2 + 2H^+ \rightarrow Ni^{++} + 2H_2O$$

$$Cr(OH)_3 + 3H^+ \rightarrow Cr^{+++} + 3H_2O$$

$$CuCO_3.Cu(OH)_2 + 4H^+ \rightarrow 2Cu^{++} + CO_2 + 3H_2O$$

The metal ions formed by these reactions pass through the filtering membrane or the ion-exchange membrane and move towards the cathode compartment. The metal ions are combined with electrons on the cathode and precipitate as metals thereon, for example, according to the reaction shown by the following formula:

$$Ni^{++} + 2e^- \rightarrow Ni$$

In this case, the sludge to be treated may be added to the anode compartment or the intermediate compartment before initiation of the electrolytic treatment or may be added continuously in suitable portions to the anode compartment or the intermediate compartment according to the changes in the composition of the electrolytic solution and the pH value thereof.

In practice of the method of this invention, it is also possible that the electrolytic solution is taken out from the anode compartment, mixed with the sludge in another vessel and then returned to the anode compartment.

In the present invention, the sludge may be added to the anode compartment or the intermediate compartment in an excess amount exceeding solubility of the sludge. No particular limitation exists in the amount of the sludge to be supplied. However, the sludge is preferably supplied in such an amount that a deposit of the sludge in the compartment does not effect the effective area of the filter membrane or the ion-exchange membrane. The sludge may be dispersed into the electrolytic cell.

Illustrative of the insoluble electrode utilizable as anode in the present invention are electrodes made of graphite, lead, platinum and the like inactive substance. On the other hand, the electrode utilizable as cathode in the present invention may type of the known electrodes including, in addition to insoluble ones mentioned for the anode, those made of metals, alloys, semiconductors, oxides and the like.

The filter membrane is provided for preventing removal of sparingly soluble metal compounds and other insoluble solid particles contained in the sludge supplied to the anode compartment or the intermediate compartment towards the cathode compartment. Filter cloth, felt cloth, sponge and the like can conveniently be used as the filter membrane. In this case, an ion-exchange membrane can be used in place of the filter membrane. The use of a cation-exchange membrane easily permits removal of metal ions in the anode compartment to the cathode compartment. Thus, the use of different electrolytes for anolyte and catholyte, for example, the use of an aqueous solution of nickel sulfide as anolyte and an aqueous solution of nickel chloride as catholyte permits electrolysis of the nickel salt without generation of a toxic gas such as chlorine on the cathodic side.

In the method of this invention, the pH value of the electrolytic solution is kept in an acid region. In the anode compartment, the pH value is preferably kept at 0 - 5.5 to promote dissolution of metals contained in the sludge. If the pH value exceeds 5.5, solubility of metals contained in the sludge tends to decrease. In the cathode compartment, the pH value of the catholyte is preferably kept at 1 - 5. If the pH value is 1 or less, the acidity of the catholyte becomes too high whereby hydrogen is evolved and precipitation of the metals is disturbed.

The electrolytic voltage is kept preferably within the range of 3 - 15V, more preferably within the range of 5 - 10V. The current density is kept preferably within the range of 0.1 - 10A/dm$^2$, more preferably within the range of 1.0 - 5.0 A/dm$^2$.

According to the method of this invention wherein an inert electrode is used as anodic electrode and a sludge containing sparingly soluble metal compounds is supplied to the anode compartment or the intermediate compartment, hydrogen ions formed during electrolysis are exclusively used for dissolution of the sparingly soluble metal compounds so that the concentration of the metal ions in the electrolytic solution as well as the property thereof such as pH value is kept definite, thus serving to maintain high current efficiency. The property of the precipitated metal is also kept definite so that there is no fear in the precipitated metal of any deformation such as pit or crack caused by excessively high internal stress. As the cathode compartment is separated by the filter membrane or the ion-exchange membrane from the anode compartment or the intermediate compartment to which a sludge is supplied, the electrolytic solution in the cathode compartment is kept clean at all times so that there is not brought about such a disadvantage that sparingly soluble metal compounds contained in the sludge and other solid matters are intruded into the electrolytic solution in the cathode compartment and attached to the cathode or the precipitated metal to cause deterioration of the quality of the precipitated metal or lowering of the current efficiency.

In the method of the present invention, therefore, the desired electrolytic treatment can efficiently be carried out continuously for a long period of time whereby metals with the desired property can economically be recovered.

The method of the present invention can be applied to the treatment of sludges containing one or more sparingly soluble compounds of various metals, such as oxides, hydroxides and salts of zinc, copper, nickel and chromium. In the case of treating sludges containing $Cr^{3+}$ compounds, the chromium component can be recovered according to the present invention by anodic oxidation of the $Cr^{3+}$ compound to an oxyacid ($Cr_2O_7^{2-}$).

To further illustrate the present invention, and not by way of limitation, the following example is given.

EXAMPLE 1

Figure 2:
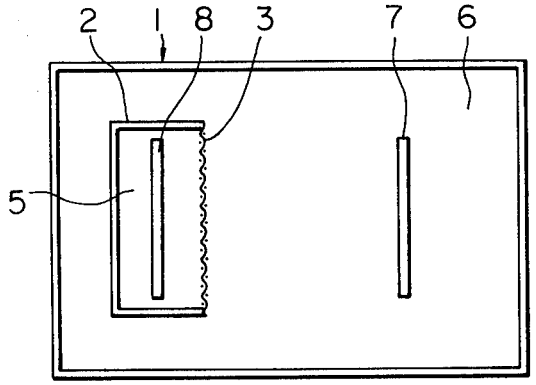
FIG. 2 is a plan view of the electrolytic cell.

An apparatus shown, for example, in FIG. 1 or 2 is used for working the present invention. In an electrolytic cell 1, a cubic container 2 made of polyvinyl chloride of which one of the perpendicular walls was replaced by a felt cloth 3 was dipped into an electrolytic solution 4 in the electrolytic cell 1 to prepare an anode compartment 5. The remaining part in the electrolytic tank 1 was used as an cathode compartment 6. One liter of an aqueous solution of nickel sulfate with a concentration of 1 mol/liter having dissolved therein 30 g of boric acid was used as the electrolytic solution 4. A calendered copper plate one side of which was coated with an insulating material and a platinum plate were used as a cathode 7 and an anode 8, respectively. While keeping the temperature of the solution at 45° C, a nickel carbonate sludge having an average moisture content of 85% was added to the anode compartment 5 at a rate of 100 - 150 g/hour. An electrolytic treatment of the sludge was carried out under the following condition:

Electric current: 6.25 A

Total quantity of electricity: 600,000 coulomb

In this electrolytic treatment, 8.90 g of precipitated nickel were obtained at every 30,000 coulomb. The following table shows the concentration of nickel in the catholyte, pH values of the anolyte and catholyte and the amount of nickel precipitated at every 30,000 coulomb.

| Item | Before electrolysis | After electrolysis ( × 10$^3$ coulomb) | | | | |
|---|---|---|---|---|---|---|
| | | 30 | 60 | 90 | 120 | 600 |
| Concentration of nickel in catholyte (g) | 54.50 | 47.81 | 47.01 | 47.00 | 46.90 | 47.00 |
| Amount of nickel precipitated (g) | — | 8.90 | 8.90 | 8.90 | 8.90 | 8.90 |
| Cathode Efficiency (%) | — | 97.7 | 97.6 | 97.6 | 97.6 | 97.6 |
| pH value (catholyte) | 4.07 | 4.82 | 4.92 | 4.95 | 4.95 | 4.95 |
| pH value (anolyte) | 5.02 | 5.02 | 5.00 | 5.00 | 5.00 | 5.00 |

Figure 3:
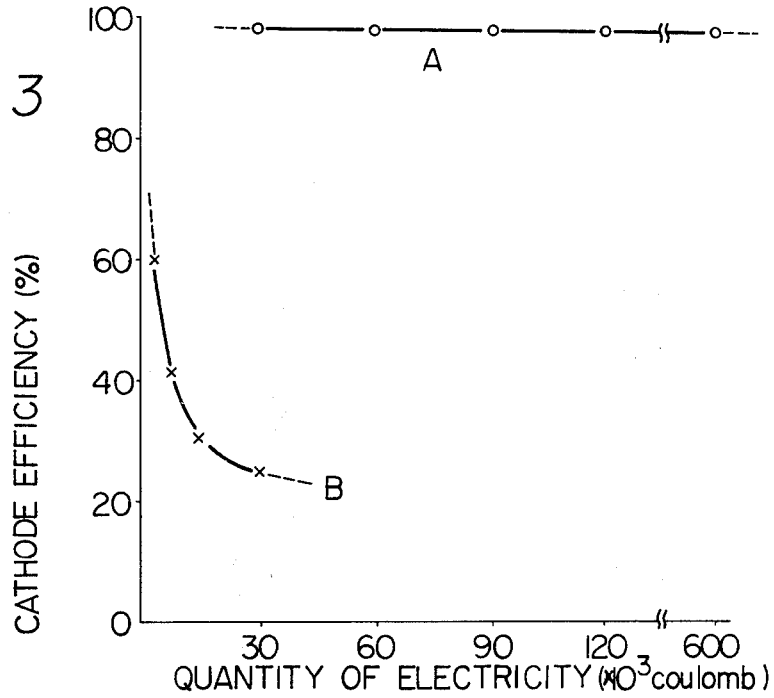
FIG. 3 is a graph showing a relation between the quantity of electricity and the cathode efficiency.
Figure 4:
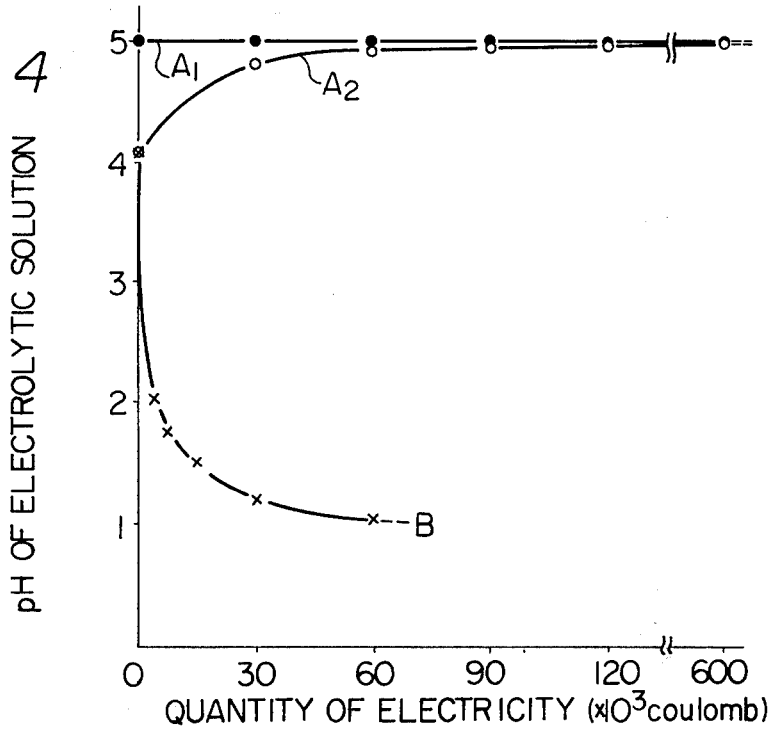
FIG. 4 is a graph showing a relation between the quantity of electricity and the pH value of the electrolytic solution.

The relations between the quantity of electicity and the cathode efficiency and between the quantity of electricity and the pH of the electrolytic solutions are shown in FIGS. 3 and 4, respectively, together with the case wherein the sludge was not supplied to the anode compartment.

In the event the sludge was not supplied to the anode compartment, the concentration of nickel ion in the electrolytic solution was decreased with the lapse of time and also the efficiency at the cathode and the pH of the electrolytic solutions were rapidly decreased with the lapse of time as shown by the line 3B in FIGS. 3 and 4. In this case, it was observed that pits and cracks were formed in the precipitated metal and the quality of the recovered metal was considerably deteriorated.

In contrast, when the sludge was supplied to the anode compartment according to the method of this invention, not only the pH values of the electrolytic solutions were kept constant but also was the cathode efficiency kept higher and constant, as shown by the line A in FIG. 3 and by the lines $A_1$ and $A_2$ in FIG. 4 standing for the pH values of the anolyte and catholyte, respectively.

EXAMPLE 2

Using a cupric hydroxide sludge (containing partially cupric oxide) obtained by neutralizing a solution containing cupric ion, an electrolytic treatment was carried out in the same apparatus as described in Example 1 to recover copper by way of electrolysis.

One liter of an aquous solution of cupric sulfate with a concentration of 1 mol/liter having dissolved therein 10 g of sulfuric acid was used as an electrolytic solution and a cupric hydroxide sludge (containing partially cupric oxide) having an average moisture content of 90% was supplied to the anode compartment at a rate of about 120 - 150 g per hour. The electrolytic treatment of the sludge was conducted at an electric current of 5.4 A whereby fine metallic copper with good adhesiveness was built up on the surface of the cathode at a rate of 6.3 g per hour. In this case, smooth dissolution of cupric hydroxide in the sludge added to the anode compartment is necessary for smooth supply of cupric ion to the cathode compartment. Since dissolution of $Cu(OH)_2$ was promoted by oxygen generated at the anode and this purpose was also attained by the reaction between sulfuric acid and cupric hydroxide, dissolution of the copper components contained in the sludge was attained in the anode compartment with a quantity of electricity considerably smaller than the theoretically needed quantity. According to this method, a quantity of electricity as small as about 3KW was sufficient enough to attain recovery of 1 Kg of copper.

As many apparently widely different embodiments of the present invention may be made without departing from the spirit and scope thereof, it is to be understood that the invention is not limited to the specific embodiments thereof except as defined in the appended claims.

What is claimed is:

1. A method of recovering metals from sludges, characterized by supplying a sludge containing metal compounds that are sparingly soluble in alkaline solutions selected from the group consisting of metal oxides, hydroxides, carbonates and basic carbonates to an anode compartment or an intermediate compartment of an electrolytic cell provided with an anode compartment and a cathode compartment or with an anode compartment, an intermediate compartment and a cathode compartment each sectioned by a filter membrane or a cation permeable ion-exchange membrane, and conducting electrolysis by using an insoluble electrode generating as anode and an acidic electrolyte at said anode in which said metal compounds are soluble and precipitate metals dissolved from said sludges, on the cathode.

2. The method of claim 1 wherein the pH value of the anolyte is within the range of 0 - 5.5 and that of catholyte is within the range of 1 - 5.

3. The method of claim 1 wherein said filter membrane is a filter cloth, a felt cloth or a sponge.

4. The method of claim 1 wherein said electrolytic treatment is conducted at a current density of 0.1 - 10 $A/dm^2$.

5. The method of claim 1, in which said metal oxides, hydroxides, carbonates and basic carbonates are selected from the group consisting of zinc, nickel, copper and chromium metal compounds.

6. The method of claim 1, in which said metal compounds become soluble in an acid formed by the electrolysis reaction.

* * * * *